US011440775B2

(12) United States Patent
Kashiwakura

(10) Patent No.: US 11,440,775 B2
(45) Date of Patent: Sep. 13, 2022

(54) DOOR ENGAGEMENT DEVICE

(71) Applicant: FUJITEC CO., LTD., Hikone (JP)

(72) Inventor: Hiroshi Kashiwakura, Hikone (JP)

(73) Assignee: FUJITEC CO., LTD., Hikone (JP)

( * ) Notice: Subject to any disclaimer, the term of this patent is extended or adjusted under 35 U.S.C. 154(b) by 64 days.

(21) Appl. No.: 17/043,005

(22) PCT Filed: Mar. 6, 2020

(86) PCT No.: PCT/JP2020/009692
§ 371 (c)(1),
(2) Date: Sep. 29, 2020

(87) PCT Pub. No.: WO2020/179911
PCT Pub. Date: Sep. 10, 2020

(65) Prior Publication Data

US 2021/0009383 A1 Jan. 14, 2021

(30) Foreign Application Priority Data

Mar. 7, 2019 (JP) ..... JP2019-041375

(51) Int. Cl.
*B66B 13/12* (2006.01)
*E05F 15/643* (2015.01)

(52) U.S. Cl.
CPC ..... *B66B 13/12* (2013.01); *E05F 15/643* (2015.01); *E05Y 2900/104* (2013.01)

(58) Field of Classification Search
CPC ..... B66B 13/12; E05F 17/002; E05F 15/643
See application file for complete search history.

(56) References Cited

U.S. PATENT DOCUMENTS 9,656,835 B2 5/2017 Kitazawa
10,207,900 B2 2/2019 Kitazawa

FOREIGN PATENT DOCUMENTS

CN 104773636 A * 7/2015
CN 107381305 A * 11/2017
JP 2011148635 A * 8/2011
WO 2015008386 A1 1/2015
WO 2016059685 A1 4/2016
WO 2018138896 A1 8/2018
WO WO-2018138896 A1 * 8/2018 ..... B66B 13/12

OTHER PUBLICATIONS

Machine Translation of CN 104773636.*

* cited by examiner

*Primary Examiner* — Diem M Tran
(74) *Attorney, Agent, or Firm* — The Webb Law Firm

(57) ABSTRACT

Provided is a door engagement device including: a first member that extends in a vertical direction and is able to come into contact with an engaged part from a door closing direction side; a second member that extends in the vertical direction at a position with a distance from the first member to a door opening side and is able to come into contact with the engaged part from a door opening direction side; a pair of link members that form a parallel link mechanism in cooperation with the first member so as to enable the first member to pivotally move between a predetermined first position and a predetermined second position located closer to the door closing direction side than the first position while keeping the posture of the first member; and a restricting part that releasably restricts the pivotal movement of the first member at the first position.

10 Claims, 13 Drawing Sheets

DOOR ENGAGEMENT DEVICE

CROSS-REFERENCE TO RELATED APPLICATIONS

This application is the United States national phase of International Application No. PCT/JP2020/009692 filed Mar. 6, 2020, and claims priority to Japanese Patent Application No. 2019-041375 filed Mar. 7, 2019, the disclosure of which are hereby incorporated by reference in their entirety.

FIELD

The present invention relates to a door engagement device for an elevator that is configured to transmit driving force to open and close a car door to a landing door or vice versa.

BACKGROUND

Conventionally, an engagement device for an elevator that is configured to transmit driving force to open and close a car door to a landing door has been known (see Patent Literature 1).

As shown in FIG. 13, the engagement device includes a door pocket side blade 910 and a door stopper side blade 920 mounted to a car door 801. The door pocket side blade 910 and the door stopper side blade 920 extend in the vertical direction and are arranged with a distance from each other in the opening and closing direction of the car door 801. The door pocket side blade 910 and the door stopper side blade 920 respectively form parallel link mechanisms 911, 921.

According to the engagement device 900, when the car 800 lands a landing floor and the car doors 801 open, the link mechanisms 911, 921 are actuated to shorten the distance between the door pocket side blade 910 and the door stopper side blade 920. Thereby, interlock rollers (engaged part) 710 of a landing door 701 are held by (engaged with) the door pocket side blade 910 and the door stopper side blade 920. By the opening and closing of the car door 801 in this state, driving force to open and close the car door 801 is transmitted to the landing door 701 via the engagement device 900. Thereby, the landing door 701 opens and closes in association with the opening and closing of the car door 801.

CITATION LIST

Patent Literature

Patent Literature 1: WO 2016/059685 A

SUMMARY

Technical Problem

According to the elevator including the aforementioned engagement device 900, there is a case where the engagement device 900 of the car door 801 is replaced with a new engagement device 900 for repair or the like with the engaged part 710 of the landing door 701 remaining unchanged and the new engagement device 900 has a different size from a planned size due to, for example, the different manufacturer for the new engagement device 900. In such a case, the door pocket side blade 910 and the door stopper side blade 920 may not be able to sufficiently hold the engaged part 710 at the time of opening and closing the car door 801 so that the landing door 701 cannot timely follow the opening and closing of the car door 801 (that is, causes delay or the like); or the interlock rollers 710 may contact either blade 910 or 920 when the car 800 lands the landing floor or passes the same, which contact may cause breaking of the interlock electric contact and hence emergency stop of the elevator.

It is therefore an object of the present invention to provide a door engagement device capable of adjusting a distance between the members to be engaged with an engaged part on the opposite door.

Solution to Problem

A door engagement device of the present invention is configured to to engage with an engaged part, which is mounted to a landing door or a car door of an elevator, and thereby be able to transmit driving force to open and close the car door or the landing door, the door engagement device including: a first member that extends in a vertical direction and is able to come into contact with an engaged part from a door closing direction side; a second member that extends in the vertical direction at a position with a distance from the first member to a door opening side and is able to come into contact with the engaged part from a door opening direction side; a link member that forms a parallel link mechanism in cooperation with the first member so as to enable the first member to pivotally move between a predetermined first position and a predetermined second position located closer to the door closing direction side than the first position while keeping the posture of the first member; and a restricting part that releasably restricts the pivotal movement of the first member at the first position.

In the door engagement device, the restricting part is preferably capable of restricting the pivotal movement of the first member at a desired position between the first position and the second position.

In this case, the door engagement device may be configured such that, for example, the restricting part includes: at least one first member contact part that restricts the first member from further pivotally moving toward the second position side, when the at least one first member contact part has come into contact with the first member from the door closing side; and a holding part that holds the first member contact part, while being fixed to the car door or the landing door, the holding part having a screw hole extending in the door closing direction, the number of which corresponds to the number of the first member contact part, the at least one first member contact part having a screw part to be screwed in the screw hole from the door opening side.

The door engagement device may be configured such that the restricting part includes at least one link member contact part that restricts the first member from further pivotally moving toward the first position when the at least one link member contact part has come into contact with the link member, and the holding part holds the at least one link member contact part in such a manner as to be able to adjust the position of the at least one link member contact part.

In this case, it may be configured such that the at least one link member contact part has the same configuration as the at least one first member contact part, and the holding part has a screw hole, into which the screw part of the at least one link member contact part is screwed, the number of the screw hole corresponding to the at least one link member contact part.

In the door engagement device, the first member may include a connection part for connecting a transmission member of a locking member that locks and unlocks the car door or the landing door by motion transmitted by the transmission member.

DESCRIPTION OF EMBODIMENTS

Hereinafter, the first embodiment of the present invention will be described with reference to FIG. 1 to FIG. 7

Figure 1:
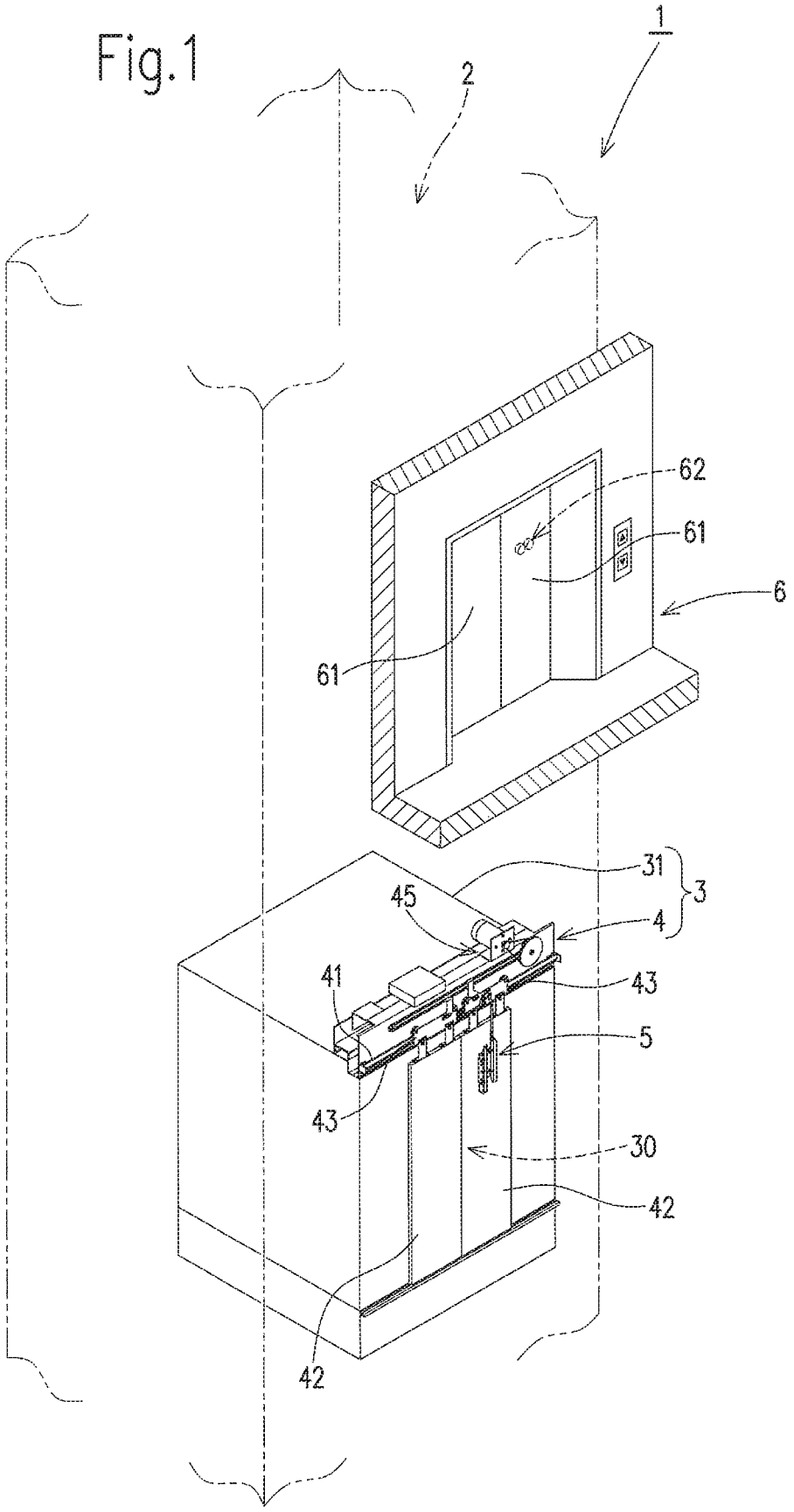
FIG. 1 is a schematic diagram showing a configuration of an elevator according to a first embodiment.

As shown in FIG. 1, in an elevator 1 including an elevator shaft 2 that extends in the vertical direction throughout a plurality of floors in a building, and a car 3 that is raised or lowered within the elevator shaft 2, a door engagement device 5 (hereinafter also referred to simply as "engagement device") according to this embodiment is mounted to a car door 42 that opens and closes an entrance 30 of the car 3. The engagement device 5 is configured to engage with landing doors 61 (specifically, engaged part 62) when the car 3 lands a desired floor (i.e., the landing floor), to thereby make the landing doors 61 follow the motion of the car door 42 when the car door 42 opens and closes.

The car 3 includes a car body 31 having the entrance 30, and a door device 4 having the car door 42 and arranged in the car body 31, and the engagement device 5 is mounted to the car door 42 of the door device 4. That is, the door device 4 includes the engagement device 5.

Figure 2:
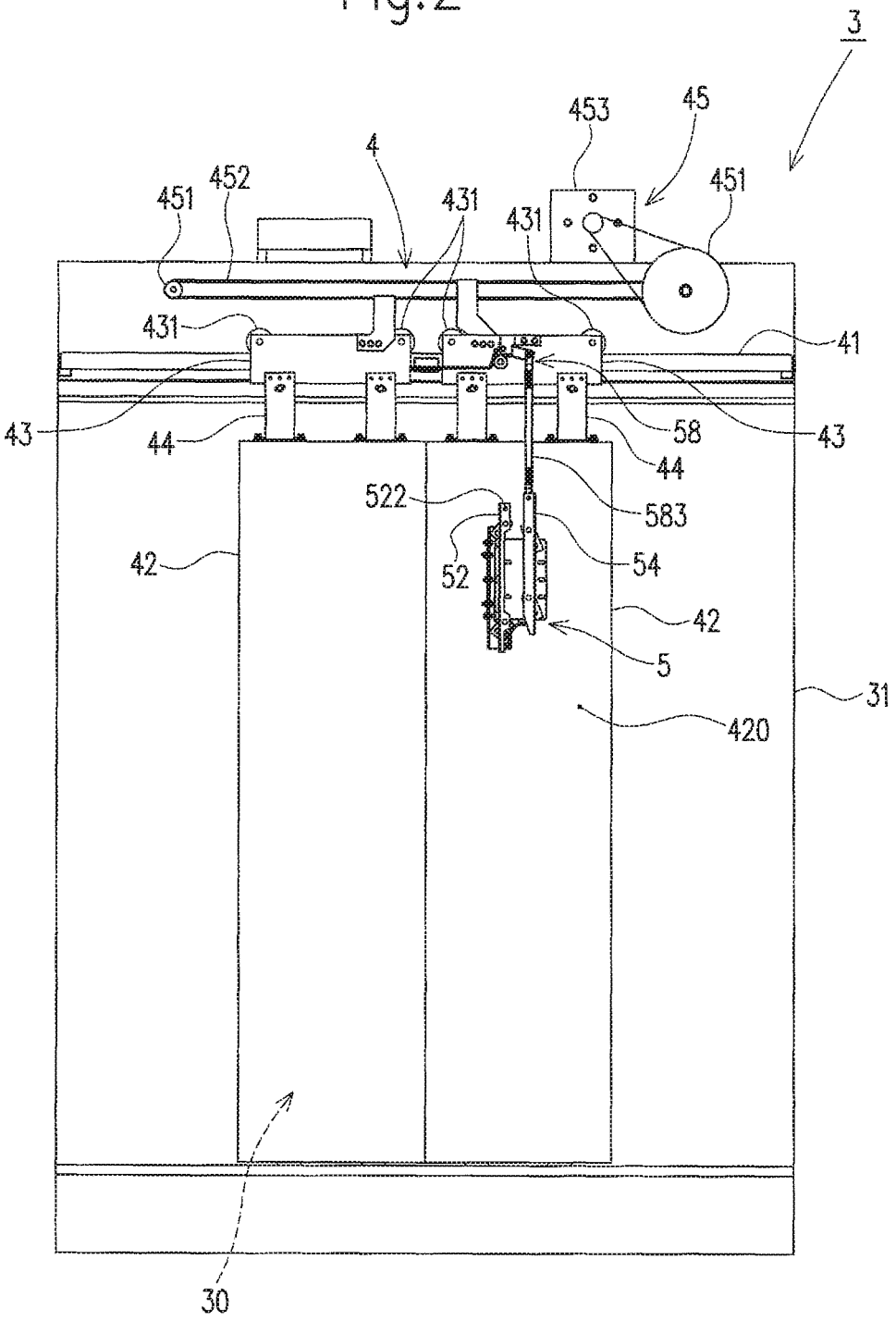
FIG. 2 is a front view of a car of the elevator.
Figure 3:
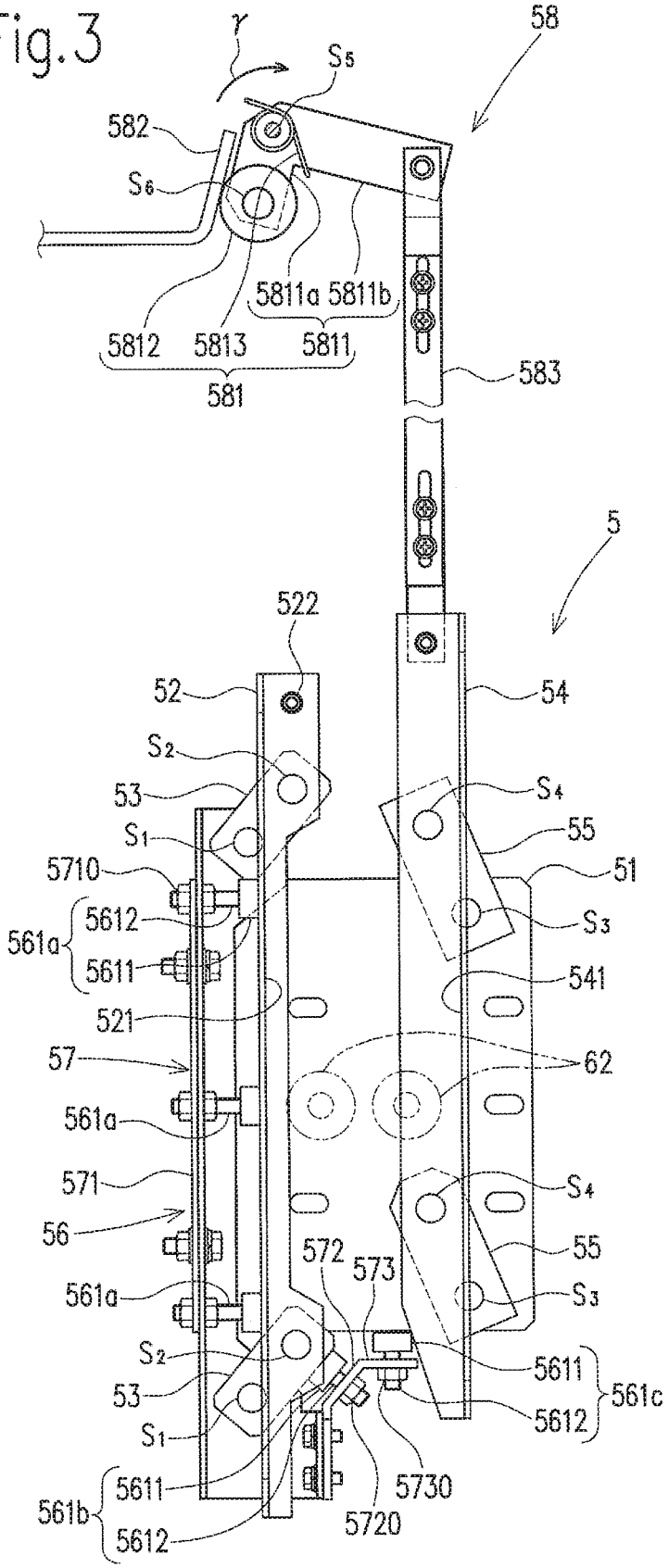
FIG. 3 is an explanatory diagram for the configuration of an engagement device arranged on a door device of the elevator.

As shown in FIG. 2, the door device 4 includes a guide rail 41 that extends in the width direction (i.e., the left-right direction in FIG. 2: hereinafter also referred to as "the opening and closing direction") above the entrance 30 of the car 3, the car door 42 that is configured to open and close the entrance 30 of the car body 31, a door hanger 43 that allows the car door 42 to reciprocate along the guide rail 41 while allowing the car door 42 to hang down therefrom, and the engagement device 5 that is mounted to the car door 42. The door device 4 of this embodiment is a so-called center open type door device and includes two car doors 42 that can move toward and away from each other in the opening and closing direction.

The door device 4 further includes a driving device 45 or the like that drives the car doors 42 via the door hanger 43 in the opening and closing direction. The driving device 45 is arranged in the car body 31 and drives the car doors 42 directly or indirectly.

Specifically, the driving device 45 includes a plurality of pulleys 451 that are mounted at an interval in the opening and direction above the guide rail 41, an endless annular belt body 452 that is wound around the plurality of pulleys 451, and a motor 453 that rotary drives at least one of the plurality of pulleys 451.

The guide rail 41 extends in the opening and closing direction above the entrance 30 of the car body 31 to guide the car doors 42 (specifically, the door hanger 43 with the car doors hanging down therefrom). Each of the car doors 42 is a panel having a vertically elongated rectangular shape.

The door hanger 43 is connected to the belt body 452 of the driving device 45 and is reciprocatable along the guide rail 41 while having the car doors 42 directly or indirectly hanging down therefrom. The door hanger 43 of this embodiment allows the car doors 42 to hang down therefrom via an intermediate member 44. The door hanger 43 includes a plurality of rollers 431 that roll on the guide rail 41 when reciprocating along the guide rail 43.

The engagement device 5 transmits driving force to open and close the car doors 42 to the landing doors 61. The engagement device 5 is mounted to an opposite surface 420 of the car door 42 facing the landing door 61 and is engageable with the engaged part 62 of the landing door 61 when the car 3 lands a desired floor. The engagement device 5 of this embodiment is mounted to one of the two car doors 42. The engaged part 62 of the landing door 61 of this embodiment is a so-called catch roller (see FIG. 3).

Specifically, as shown in FIG. 3 to FIG. 7, the engagement device 5 includes a base 51 for fixing the engagement device 5 to the car door 42, a first member 52 extending in the vertical direction, a pair of first link members (link member) 53, which, together with the first link member 52, form a parallel link mechanism, a second member 54 extending in the vertical direction at a position with a distance from the first member 52 on the entrance side (on the right side in FIG. 3 and FIG. 4), a pair of second link members 55, which, together with the second member 54, form a parallel link mechanism, a restricting part 56 that can restrict the motion of the first member 52, and a second member driving mechanism 58 that drives the second member 54 in association with the opening and closing of the car door 42. In the engagement device 5 of this embodiment, the restricting part 56 can also restrict the second member 54. The restricting part for restricting the motion of the first member 52 and the restricting part for restricting the motion of the second member 54 may be provided separately.

The base 51 is a plate-shaped member expanding along the car door 42 (i.e., the opposite surface 420) and fixed to the opposite surface 420 of the car door 42.

The first member 52 is a member that can come into contact with the engaged part 62 from the door closing direction side and has a first holding surface 521 expanding in the vertical direction and the entrance direction (i.e., the direction in which passengers or the like enter the car 3 through the entrance 30) and facing toward the door opening direction. The first member 52 of this embodiment is a so-called angle member extending in the vertical direction and having an L-shape in the cross section.

Figure 10:
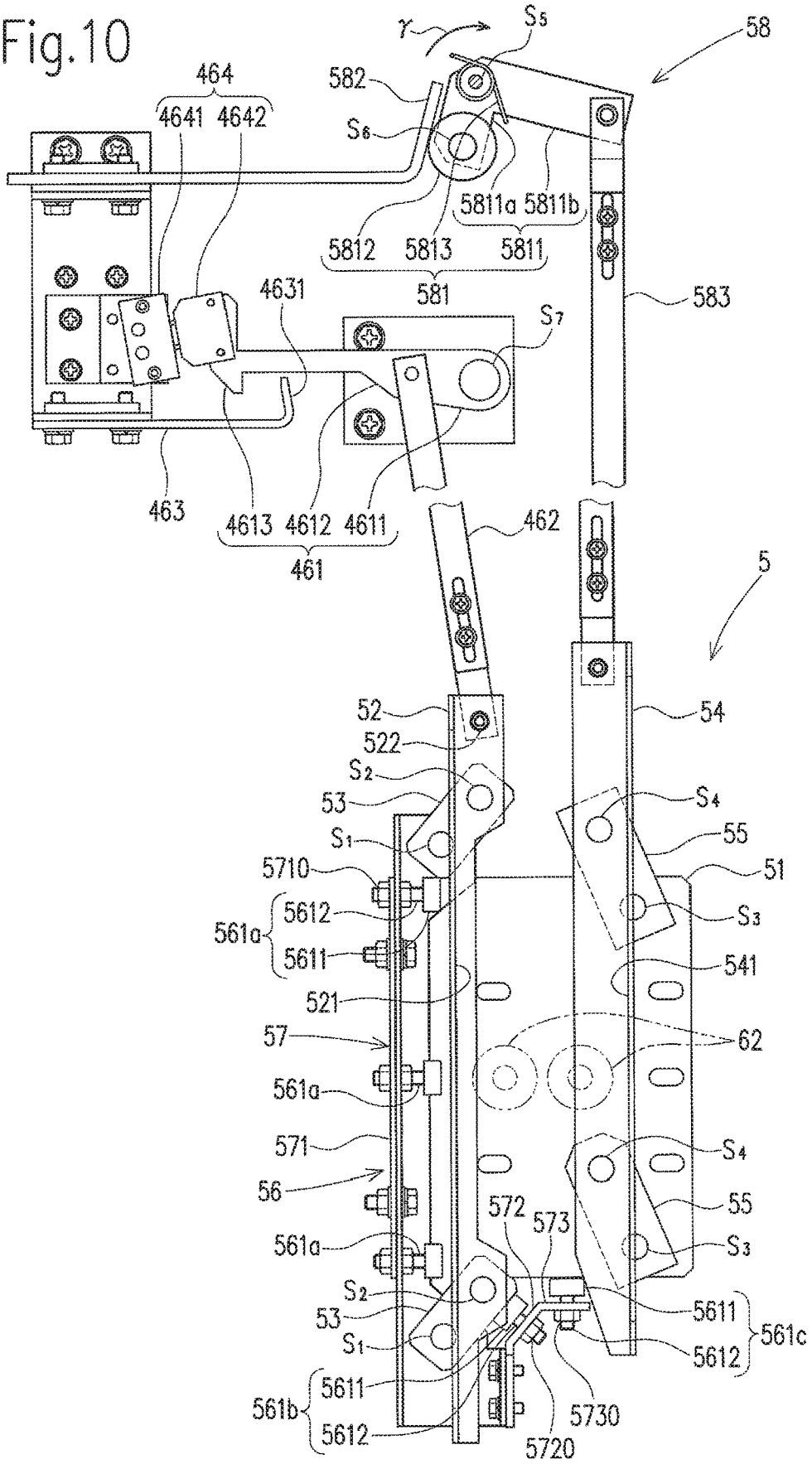
FIG. 10 is an explanatory diagram for the configuration of an engagement device and a locking mechanism arranged in a door device of the elevator.

The first member 52 further includes a connection part 522 to which an elongated transmission member 462 is connectable (for example, see FIG. 10). The transmission member 462 is, when the door device 4 includes a locking mechanism for locking and unlocking the car door 42, a member for transmitting the motion (i.e., the driving force) of the first member 52 to the locking mechanism. The connection part 522 of this embodiment includes a hole, through which a bolt for connection of the transmission member 46 is inserted, a bearing for receiving the bolt, and the like.

The pair of first link members 53 connect the base 51 with the first member 52 and are arranged with a distance from each other in the vertical direction. Each of the first link members 53 is connected to the base 51 to be relatively rotatable around a shaft $S_1$ extending in the entrance direction, while being connected to the first member 52 to be relatively rotatable around a shaft $S_2$ extending in the entrance direction. This configuration allows the pair of first link members 53 to, together with the first member 52, form the parallel link mechanism, and thereby allows the first member 52 to pivotally move (swing) with maintaining the position of the first holding surface 521 at which the first holding surface 521 faces a certain direction (i.e., the door opening direction) (see the arrow α in FIG. 4). Each of the first link members 53 of this embodiment has a rectangular plate shape. In FIG. 3 to FIG. 7, the first member 52 is unable to pivotally move since the restricting part 56 restricts the first member 52 from pivotally moving, but the first member 52 is enabled to pivotally move by adjusting the position of the first member contact part 561*a*.

The second member 54 is a member that can come into contact with the engaged part 62 from the door opening direction side and has a second holding surface 541 expanding in the vertical direction and the entrance direction and facing toward the door closing direction. The second member 54 of this embodiment is a so-called angle member extending in the vertical direction and having an L-shape in the cross section.

The pair of second link members 55 connect the base 51 with the second member 54 and are arranged with a distance from each other in the vertical direction. Each of the second link members 55 is connected to the base 51 to be relatively rotatable around a shaft $S_3$ extending in the entrance direction, while being connected to the second member 54 to be relatively rotatable around a shaft $S_4$ extending in the entrance direction. This configuration allows the pair of second link members 55 to, together with the second member 54, form the parallel link mechanism, and thereby allow the second member 54 to pivotally move (swing) with maintaining the position of the second holding surface 541 at which the second holding surface 541 faces a certain direction (i.e., the door closing direction) (see the arrow ß in FIG. 4). Each of the second link members 55 of this embodiment has a rectangular plate shape.

The restricting part 56 includes at least one first member contact part 561*a* that restricts, when coming into contact with the first member 52 from the door closing side, the first member 52 from further pivotally moving toward the door closing side, and a holding part 57 that holds the first member contact part 561*a* while being directly or indirectly fixed to the car door 42. The restricting part 56 further includes a first link member contact part 561*b* (the link member contact part) that comes into contact with the first link member 53, thereby restricting the first link member 53 from further pivotally moving. The restricting part 56 of this embodiment further includes a second link member contact part 561*c* that comes into contact with the second link member 55, thereby restricting the second link member 55 from further pivotally moving. The holding part 57 of this embodiment also holds the first link member contact part 561*b* and the second link member contact part 561*c*. The first member contact part 561*a*, the first link member contact part 561*b*, and the second link member contact part 561*c* have the same configuration.

The holding part 57 of this embodiment is fixed to the car door 42 via the base 51. That is, the holding part 57 is mounted to the base 51. The holding part 57 includes a first portion 571 that holds the first member contact part 561*a*, a second portion 572 that holds the first link member contact part 561*b*, and a third portion 573 that holds the second link member contact part 561*c*.

The first portion 571 is a portion that is located closer to the door closing direction side than the first member 52, rises (projects) from the vicinity of the opposite surface 420 of the car door 42 toward the landing door 61 side, and extends in the vertical direction. The first portion 571 projects to a position corresponding to the first member 52. The first portion 571 has a screw hole 5710 extending in the door closing direction. The first portion 571 has the number of screw holes 5710 corresponding to the number of first member contact part 561*a*. The first portion 571 of this embodiment has a plurality (3 in the example shown in FIG. 3) of screw holes 5710. The plurality of screw holes 5710 are arranged to align in the vertical direction with a distance from each other. Each of the screw holes 5710 extends through the first portion 571.

The second portion 572 is a portion that is located closer to the door opening direction side than the first link member 53 of the lower side, and projects from the vicinity of the opposite surface 420 of the car door 42 toward the landing door 61 side. The second portion 572 projects to a position corresponding to the first link member 53 while not coming into contact with the first member 52. The second portion 572 has a screw hole 5720 extending in the downwardly inclined direction toward the door closing direction side. The screw hole 5720 extends through the second portion 572.

The third portion 573 is a portion that is located closer to the door closing side direction and lower than the second link member 55 of the lower side, and projects from the vicinity of the opposite surface 420 of the car door 42 toward the landing door 61 side. The third portion 573 projects to a position corresponding to the second link member 55 while not coming into contact with the second member 54. The third portion 573 of this embodiment extends from the second portion 572. The third portion 573 has a screw hole 5730 extending in the downward direction. The screw hole 5730 extends through the third portion 573.

Screws of the same size can be screwed into the screw holes 5710, 5720, 5730 of the first portion 571 to the third portion 573 of the holding part 57 of this embodiment.

As described above, the first member contact part 561*a* has the same configuration as the first link member contact part 561*b* and the second link member contact part 561*c*. Thus, hereinafter, a specific description will be given for the configuration for the first member contact part 561*a* out of the first member contact part 561*a*, the first link member contact part 561*b*, and the second link member contact part 561*c*.

The first member contact part 561*a* includes a contact part body 5611 and a screw part 5612 extending from the contact part body 5611. A plurality (3 in the example shown in FIG. 3) of first member contact parts 561*a* are provided in this embodiment.

The contact part body 5611 is a portion having a cylindrical shape. The screw part 5612 extends along the central axis of the cylindrical contact part body 5611. The screw part 5612 is screwed in the screw hole 5710 of the first portion 571 from the first member 52 side. That is, the screw part 5612 is screwed in the screw hole 5710 of the first portion 571 so that the contact part body 5611 is located closer to the first member 52 side than the first portion 571.

In the restricting part 56, the first link member contact part 561*b* having the same configuration as the first member contact part 561*a* is arranged so that the contact part body 5611 is located closer to the first link member 53 side (on the left-upper side in FIG. 3) than the second portion 572, with the screw part 5612 being screwed in the screw hole 5720 of the second portion 572. The second link member contact part 561*c* having the same configuration as the first member contact part 561*a* is arranged so that the contact part body 5611 is located closer to the second link member 55 side (on the upper side) than the third portion 573, with the screw part 5612 being screwed in the screw hole 5730 of the third portion 573.

In the restricting part 56 configured as described above, the first member contact part 561*a* and the first link member contact part 561*b* together restrict (limit) the range of pivotal movement of the first member 52. Herein, when the position where the first member 52 is located closest to the second member 53 is designated as a first position (i.e., a position shown by the solid lines in FIG. 4), and the position where the first member 52 is located farthest from the second member 53 is designated as a second position (i.e., the position shown by the two-dot chain lines in FIG. 4), the range of pivotal movement of the first member 52 is from the first position to the second position.

The range of pivotal movement of the first member 52 toward the second position side can be changed (adjusted) by rotating the plurality of first member contact parts 561*a* around their central axes to adjust the respective positions of the contact part bodies 5611 relative to the first portion 571 of the holding part 57 (that is, the distance between the first portion 571 and the contact part bodies 5611). Also, the range of pivotal movement of the first member 52 toward the first position can be changed (adjusted) by rotating the first link member contact part 561*b* around the central axis to adjust the position of the contact part body 5611 relative to the second portion 572 of the holding part 57 (that is, the distance between the second portion 572 and the contact part body 5611).

For example, in the case where the door device 4 of the car door 3 is replaced with a new one, and the engagement device 5 may have a size not matched to the engaged part 62 of the landing door 61 for the reason that the engaged part 62 of the landing door 61 is manufactured by a manufacturer different from the manufacture of the new door device 4 (for example, there is a case where the distance between the first member 52 and the second member 54 required when the first member 52 and the second member 54 holds the engaged part 62 is sometimes unmatched to the engaged part 62).

In this case, the engagement device 5 of this embodiment adjusts the range of pivotal movement or the position of the first member 52 by the first member contact parts 561*a* and the first link member contact part 561*b*. In the engagement device 5 of this embodiment, the position of each of the first member contact parts 561*a* is adjusted so that the contact part body 5611 comes into contact with the first member 52 while the first member 52 is located at the first position (see FIG. 3). That is, the pivotal movement of the first member 52 of the engagement device 5 is restricted at the first position. The first member contact part 561*a* of this embodiment, which releasably restricts the pivotal movement of the first member 52, can thus adjust the range of pivotal movement of the first member 52 even after adjusting is made once.

In this embodiment, the pivotal movement of the first member 52 is restricted at the first position (that is, the first member 52 is fixed at the first position). However, since the distance between the first portion 571 and the contact part body 5611 can be adjusted at any distance by adjusting the screw amount of the screw part 5612, the pivotal movement of the first member 52 can be restricted at a desired position between the first position and the second position in the engagement device 5.

Figure 4:
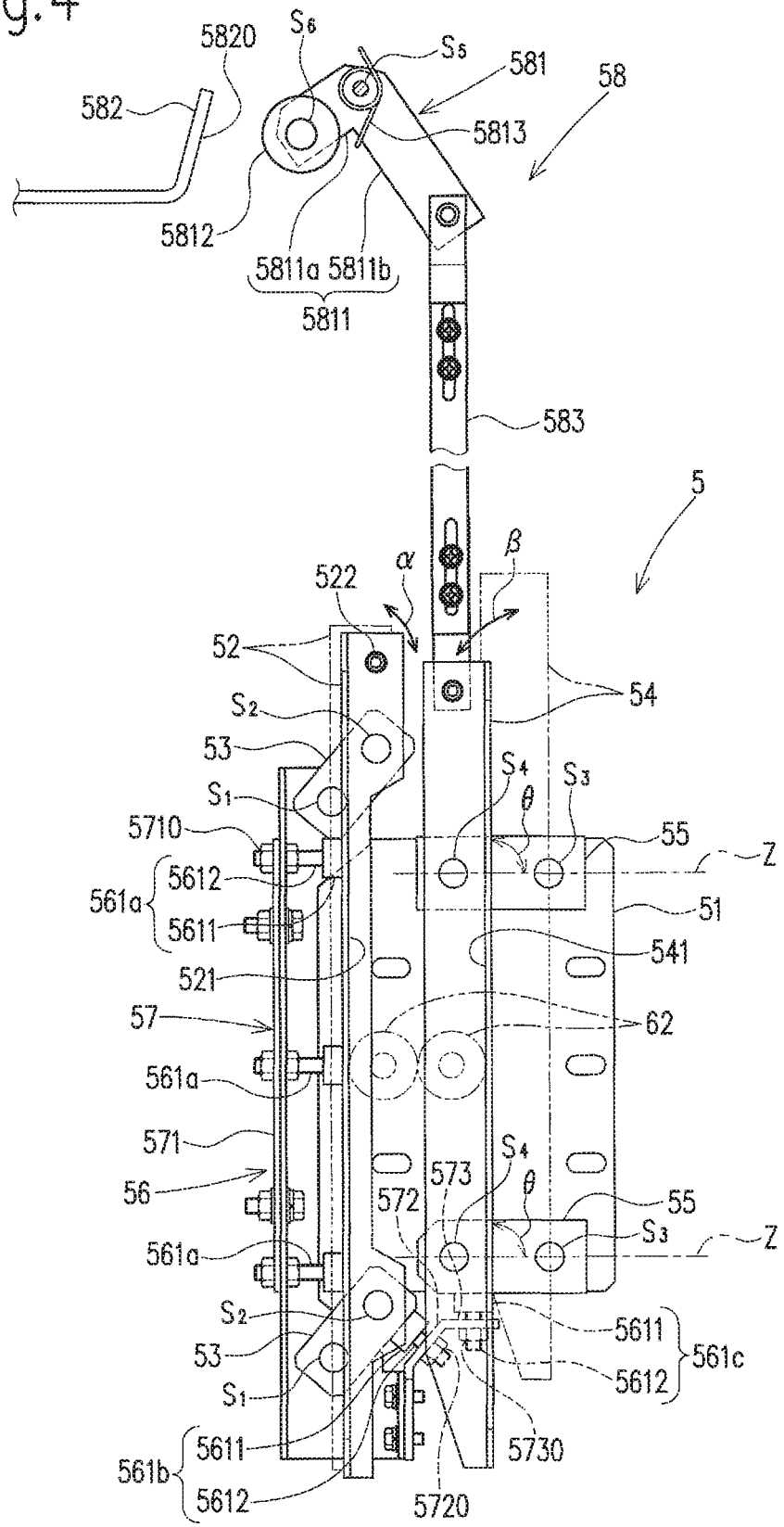
FIG. 4 is an explanatory diagram for the configuration of the engagement device in the state of holding an engaged part of a landing door.

When the position where the second member 54 is located closest to the first member 52 is designated as a third position, the range of pivotal movement of the second member toward the first member 52 is up to the third position (i.e., the position shown by the solid lines in FIG. 4). In the engagement device 5 of this embodiment, the range of pivotal movement of the second member 54 away from the first member 52 is up to a forth position defined by a second member driving mechanism 58 (i.e., the position shown by the two-dot chain lines in FIG. 4).

The second member driving mechanism 58 drives the second member 54 utilizing the opening and closing of the car door 42, to thereby allow the first member 52 and the second member 54 to hold (sandwich) the engaged part 62 of the landing door 61. Specifically, the second member driving mechanism 58 includes a cam 581 that is pivotally movable around a shaft $S_5$ extending in the entrance direction, a cam contact part 582 which the cam 581 contacts by the closing of the car door 42, and a coupling member 583 that couples the cam 581 with the second member 54.

The cam 581 includes a cam body 5811, a contact roller 5812 arranged on the cam body 5811, and a biasing member 5813 for biasing the cam body.

The cam body 5811 is a band plate-shaped member bending at an intermediate portion. Specifically, the cam body 58 includes a first portion 5811*a* having a rectangular plate shape, and a second portion 5811*b* having a rectangular plate shape and extending from an end of the first portion 5811*a* toward the direction intersecting (orthogonal to, in the example of this embodiment) the direction in which the first portion 5811 extends. The cam body 5811 is mounted to the door hanger 43 to pivotally move around the shaft $S_5$ that is arranged to extend through the boundary between the first portion 5811*a* and the second portion 5811*b*.

The contact roller 5812 is arranged on a distal end of the first portion 5811*a* (i.e., the opposite end to the boundary with the second portion 5811*b*) to be rotatable around a shaft $S_6$ extending in the entrance direction.

The biasing member 5813 biases the cam body 5811 in the rotating direction around the shaft S5 (see the arrow γ in FIG. 3) so that the distal end of the first portion 5811*a* extends upward, while a distal end of the second portion 5811*b* (i.e., the opposite end to the boundary with the first portion 5811*a*) extends downward. The biasing member 5813 of this embodiment is, for example, a coil spring, and generates a biasing force by its partial contact with (fixing to) the door hanger 43.

The coupling member 583 is a member extending in a given direction and couples the second portion 5811*b* of the cam 581 with an upper end of the second member 54. When the cam 581 pivotally moves, the coupling member 583 transmits the vertical movement of the distal end of the second portion 5811*b* in association with the pivotal movement to thereby pivotally move the second member 54. The length of the coupling member 583 of this embodiment is adjustable.

The cam contact part 582 is fixed to, for example, the car body 31. The cam contact part 582 has a contact surface 582, which the contact roller 5812 of the cam 581 contacts, when the car door 42 closes. The contact surface 5820 allows the contact roller 5812 to come into contact therewith just before the car doors 42 reach the fully-closed position in the doors closing operation, so that it prevents the contact roller 5812 from moving further toward the door closing side when the car doors 42 are further moved to close.

In the elevator 1 configured as described above, the engagement device 5 transmits the driving force (i.e., the driving force to open and close the car door 42) of the driving device 45 to the landing door 61, to thereby enable the landing door 61 to follow the opening and closing of the car door 42. That is, the landing door 61 of the landing floor 6 opens and closes in association with the car door 42 of the car 3. A specific description will be given below.

When the car is raised or lowered within the elevator shaft 2 to stop at a desired floor, the engaged part (catch roller) 62 provided on the landing door 61 enters between the first member 52 and the second member 54 from above or below (see FIG. 5).

Subsequently, the driving device 45 drives the door hangers 43 to respectively move the car doors 42, which hang down from the door hangers 42, from the fully-closed position in the door opening direction.

The first member 52 (i.e., the first holding surface 521) comes into contact with the engaged part 62 of the landing door 61 when the car door 42 moves from the fully-closed position in the door opening direction.

Also at the time of the movement of the car door 42 from the fully-closed position in the door opening direction, the contact roller 5812 separates from the cam contact part 582. Thereby, the second member 54 pivotally moves toward the first member 52 side due to the biasing force of the biasing member 5813 to hold (sandwich) the engaged part 62 together with the first member 52 therebetween (see FIG. 7).

Specifically, the second member 54 of this embodiment pivotally moves from the fourth position (the position shown by the two-dot chain line in FIG. 4) regulated by the second member driving mechanism 58 to the third position regulated by the second link member contact part 561*c*. The third position is a position closest to the first member 52 as shown in FIG. 4.

In the embodiment shown in FIG. 4, when the second member 54 is located at the third position, an angle θ (see FIG. 4) formed by a virtual line Z connecting the shaft $S_3$ and the shaft $S_4$ and the second holding surface 541 in each of the second link members 55 is 90°. According to this configuration, the second member 5 is subjected to stress in the opening and closing direction by the contact with the engaged part 62. When the stress has been transmitted to the second link member 55 via the shaft $S_4$, no force acts in a direction in which the second link member 55 pivotally moves, so that the stress can be transmitted to the base 51 via the shaft $S_3$.

Figure 5:
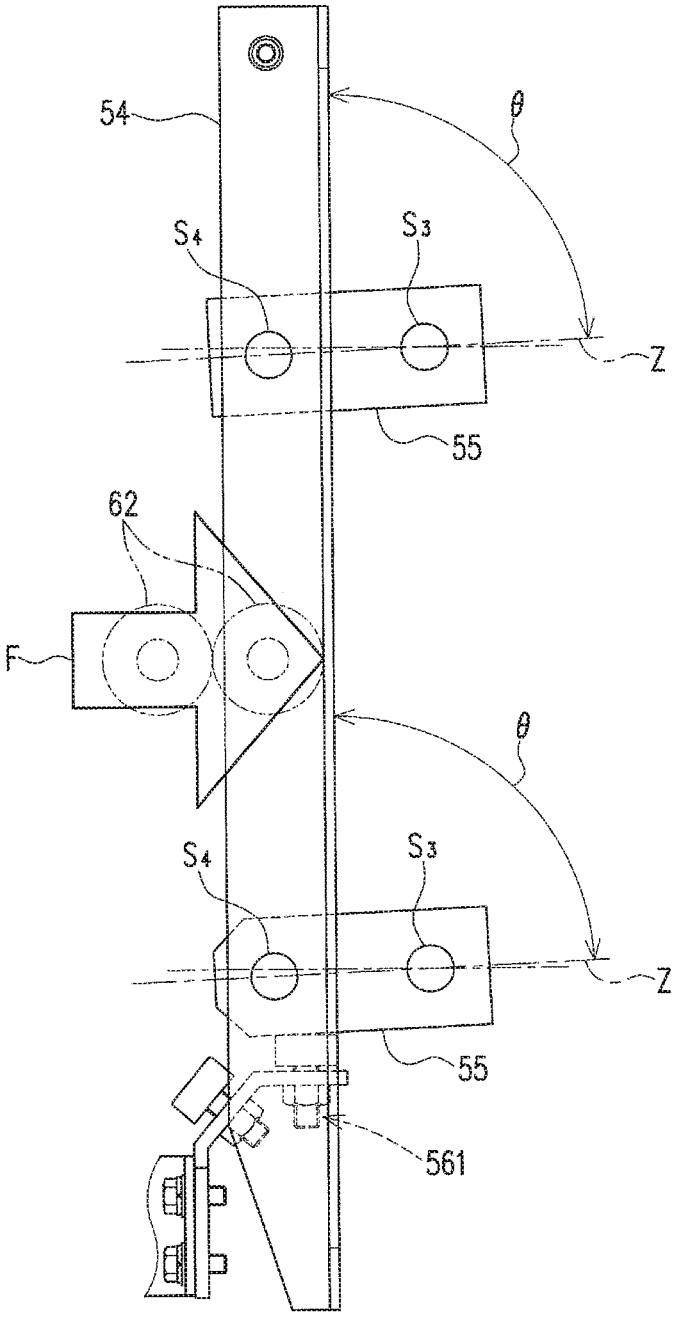
FIG. 5 is an explanatory diagram for another embodiment of the engagement device in the state of holding an engaged part of a landing door.

According to another embodiment, the movable range of the second member 54 can include a position slightly exceeding the position closest to the first member 52 as shown in FIG. 5. Specifically, the second link member contact part 561*c* can be adjusted to be positioned in the direction away from the second link member 55 so that the contacting position of the second link member 55 and the second link member contact part 561*c* is located slightly lower than the contacting position in the aforementioned embodiment. In this case, the second link member 55 takes a position allowing the virtual line Z connecting the shaft S3 and the shaft S4 to be slightly downwardly inclined toward the engaged part 62 side so that the angle θ formed by a virtual line Z and the second holding surface 541 is less than 90°. Specifically, the angle θ formed by the virtual line Z and the second holding surface 541 can be in a range of more than 89° and less than 90°, more preferably can be about 89.5°.

According to this configuration, when the second member 54 is subjected to a stress F in the opening and closing direction by the contact with the engaged part 62 and the stress has been transmitted to the second link member 55 via the shaft S4, the second link member 55 is subjected to a downward force so that the second link member 55 is slightly pushed against the second link contact part 561*c*. This configuration enables to reliably prevent the second member 54 and the second link member 55 from jumping up due to the force received from the engaged part 62, so that both of the landing door and the car door necessarily move in association with each other without deviation of the relative timing of the doors closing.

The second link member 55 to be subjected to the restriction of pivotal movement when the virtual line Z connecting the shaft $S_3$ and the shaft $S_4$ is inclined as described above may be at least one of the two second link members 55 that are vertically arranged.

According to still another embodiment, it may be configured such that the second holding surface 541 faces slightly upward when the pivotal movement of the second member 54 is restricted at the third position. This configuration enables the angle θ formed by the virtual line Z and the second holding surface 541 to be less than 90°. According to this configuration, when the second holding surface 541 has come into contact with the second link member contact part 561*c*, the second holding surface 541 receives a slightly downward stress by the second link member 561*c* in addition to the stress in the opening and closing direction, so that the second member 54 and the second link member 55 can be reliably prevented from jumping up.

In this state, when the car doors 42 respectively move further in the door opening direction, the engaged part 62 is pushed by the first member 52 in the door opening direction, while being held (sandwiched) between the first member 52 and the second member 54. Thereby, the landing doors 61 open along with the car doors 42. The two landing doors 61 of this embodiment are configured such that the opening and closing of one of the two landing doors 61 (i.e., the landing door including the engaged part 62) cause the other of the two landing doors 61 to open and close in association therewith.

On the other hand, when the doors close, the driving device 45 drives the door hangers 43 to respectively move the car doors 42, which hang down from the door hangers 43, from the fully-opened position in the door closing direction. At this time, the engaged part 62 is pushed by the second member 54 in the door closing direction, while being held (sandwiched) between the first member 52 and the second member 54, to thereby close the landing doors 61 along with the car doors 42.

At the time of this closing the doors, when the contact roller 5812 comes into contact with the cam contact part 582 and then the car doors 42 move in the door closing direction, the contact roller 5812 is pushed by the cam contact part 582 to pivotally move the cam 581 (i.e., the cam body 5811) around the shaft $S_5$. This pivotal movement allows the coupling member 583 to be pulled up against the biasing force of the biasing member 5813 and thereby allows the second member 54 to be pivotally move in the direction away from the first member 52. As a result, the second member 54 is separated from the engaged part 62 (see FIG. 6). When the second member 54 is separated from the engaged part, the landing doors 61 are arrived at the fully-closed position.

On the other hand, the first member 52 is separated from the engaged part 62 when the car doors 42 move to the fully-closed position.

Figure 6:
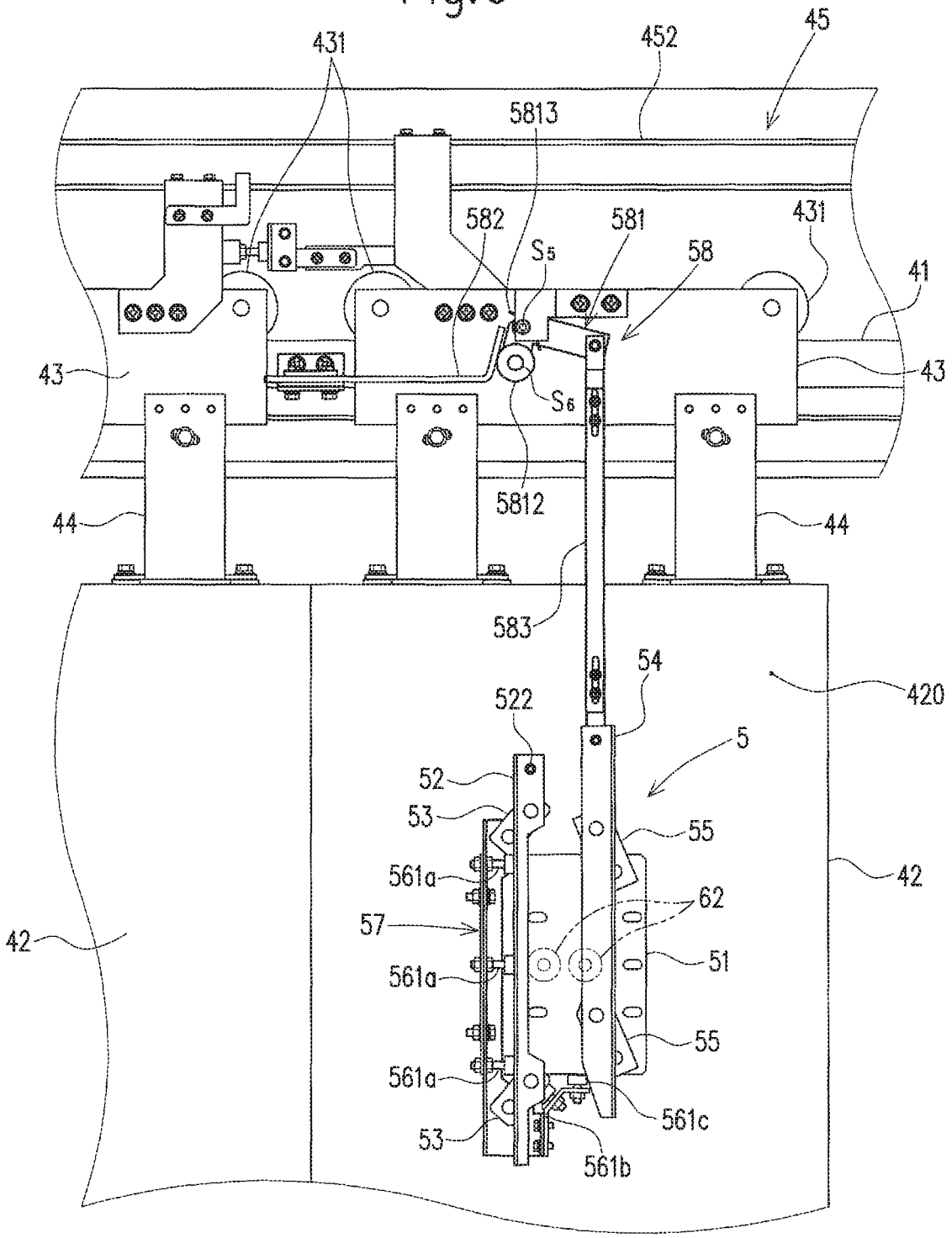
FIG. 6 is an explanatory diagram for the motion of the engagement device.
Figure 7:
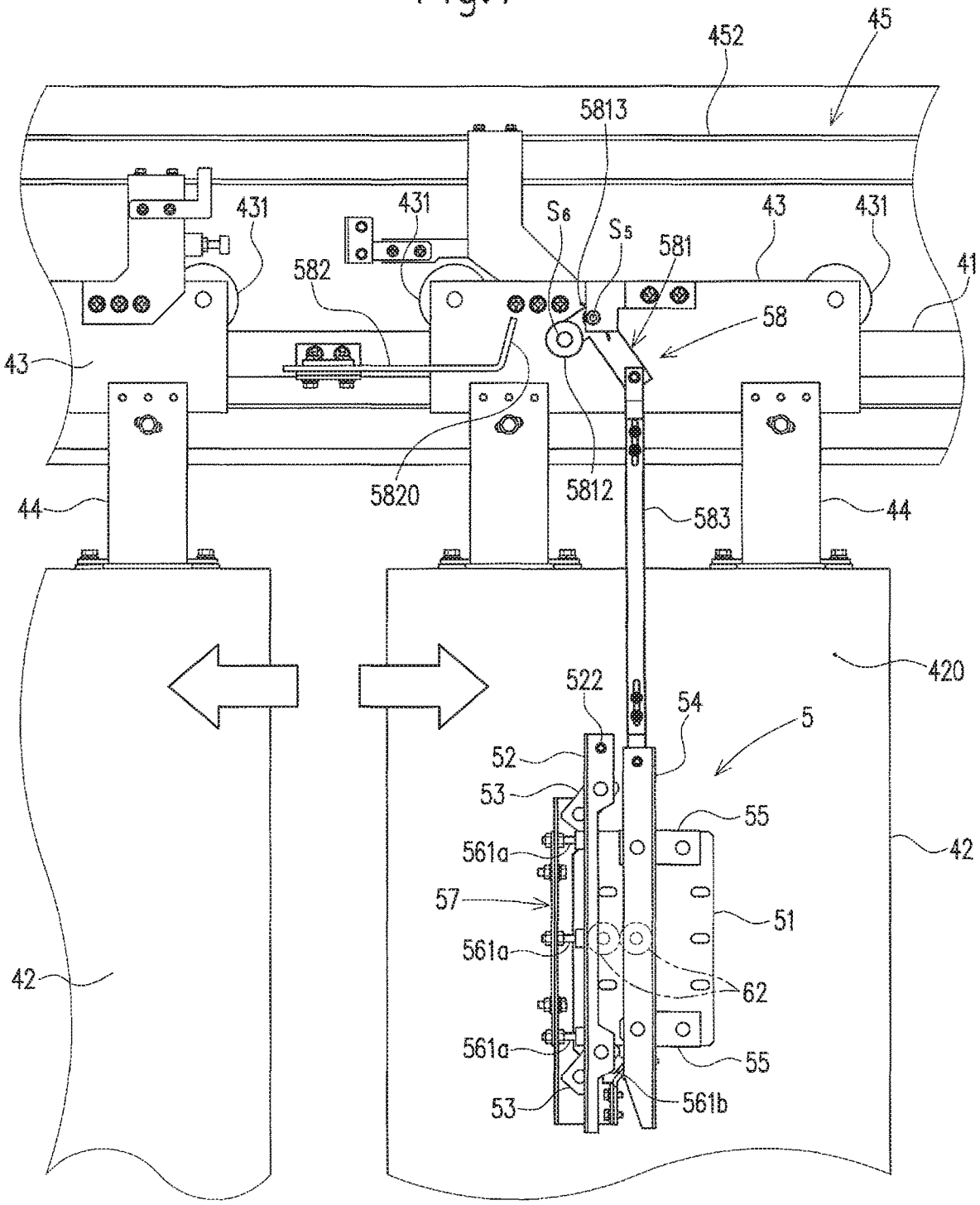
FIG. 7 is an explanatory diagram for the motion of the engagement device.

As such, the car 3 can be raised or lowered when the first member 52 and the second member 54 are respectively separated from the engaged part 62 (i.e., in the state shown in FIG. 6).

According to the aforementioned engagement device 5 of the elevator 1, the pivotal movement of the first member 52 can be restricted by the restricting part 56 at the first position. Thus, the distance between the first member 52 and the second member 54 at the time of opening and closing the car doors 42 can be adjusted to fit to the engaged part 62 of the landing doors (i.e., the opposite doors) 61 for the case where the first member 52 is restricted at the first position by the restricting part 56 (i.e., the distance between the first member 52 and the second member 54 when the first member 52 is located at the first position) and the case where the first member 52 is not restricted at the first position by the restricting part (i.e., the distance between the first member 52 and the second member 54, for example, when the first member 52 is located at the second position).

Also, according to the restricting part 56 configured to releasably bring the first member 52 into the conditions where it is restricted from pivotally moving, the distance between the first member 52 and the second member 54 can be further changed (adjusted), for example, in the case where the engaged part 62 has been replaced with a new one, even after the distance between the first member 52 and the second member 54 at the time of opening and closing the car door 42 has been adjusted to fit to the engaged part 62 of the landing door (i.e., the opposite door) 61.

The restricting part 56 of the engagement device 5 of this embodiment can restrict the first member 52 from pivotally moving at a desired position between the first position and the second position. Thus, the distance between the first member 52 and the second member 54 at the time of opening and closing the car door 42 can be more appropriately adjusted.

Specifically, in the engagement device 5 of this embodiment, the restricting part 56 of the holding part 57 (first portion 571) has the screw hole 5710 extending in the door closing direction, and the first member contact part 561*a* has the screw part 5612 to be screwed in the screw hole 5710 from the door opening side. Thus, the contact part body 5611 of the first member contact part 561*a* can be adjusted to be located at a desired position in the opening and closing direction by rotating the screw part 5612. This configuration of the engagement device 5 of this embodiment allows the first member contact part 561*a* to come into contact with the first member 52 from the door closing side at a desired position between the first position and the second position (i.e., the position to which the first member 52 is adjusted by rotating the screw part 5612) when the first member 52 has pivotally moved from the first position toward the second position side, so that the first member 52 can be restricted from further pivotally moving toward the second position side.

In the engagement device 5 of this embodiment, the first member 52 includes the connection part 522 that is capable of connecting a member for transmitting the motion (i.e., the driving force) of the first member 52. Thus, the engagement device 15 is usable in the door device 4 including a locking mechanism 46 that locks the car doors 42 using the transmitted driving force (see FIG. 10).

In the engagement device 5 of this embodiment, the restricting part 56 includes the first link member contact part 561*b* that restricts the first member 52 from further pivotally moving toward the first position side when the restricting part 56 has come into contact with the first link member 53, and the holding part 57 holds the first link member contact part 561*b* to be capable of adjusting the position of the first link member contact part 561*b*. Thus, the position of the first link member contact part 561*b* is adjusted to come into contact with the first link member 53 at a desired position between the second position and the first position when the first member 52 has pivotally moved from the second position toward the first position side, so that the first member 52 can be restricted from further pivotally moving toward the first position side.

Further, the number of parts or members can be reduced by configuring the holding part 57 to be also capable of holding the first link member contact part 561*b*, compared with the configuration where parts or members for holding the first member contact part 561*a* and the first link member contact part 561*b* are separately provided.

In the engagement device 5 of this embodiment, the first link member contact part 561*b* has the same configuration as the first member contact part 561*a*, and the holding part 57 has the screw hole(s) 5720, into which the screw part(s) 5612 are screwed, the number of which corresponds to the number of the first link member contact part 561*b* (for example, one in this embodiment). With the first link member contact part 561*b* and the first member contact part 561*a* having the same configuration, the kinds of members or parts can be reduced and the holding part 57 can have a simplified configuration. That is, the same configuration can be employed for holding the first member contact part first member contact part 561*a* as that for holding the first link member contact part 561*b*.

Moreover, in the engagement device 5 of this embodiment, the second link member contact part 561*c* has the same configuration as the first member contact part 561*a* and the first link member contact part 561*b*, and the holding part 57 also holds the second link member contact part 561*c*. Thus, the kinds of parts or members can be further reduced and the holding part 57 can have a further simplified configuration in the engagement device 5 of this embodiment compared with the configuration where the different configurations are provided respectively for holding the contact parts 561*a*, 561*b*, and 561*c*.

Next, the present invention will be described by way of the second embodiment with reference to FIG. 8 to FIG. 12. The same reference signs will be applied to the same configurations as the first embodiment, and the detailed description will be given only for the different configurations.

Figure 8:
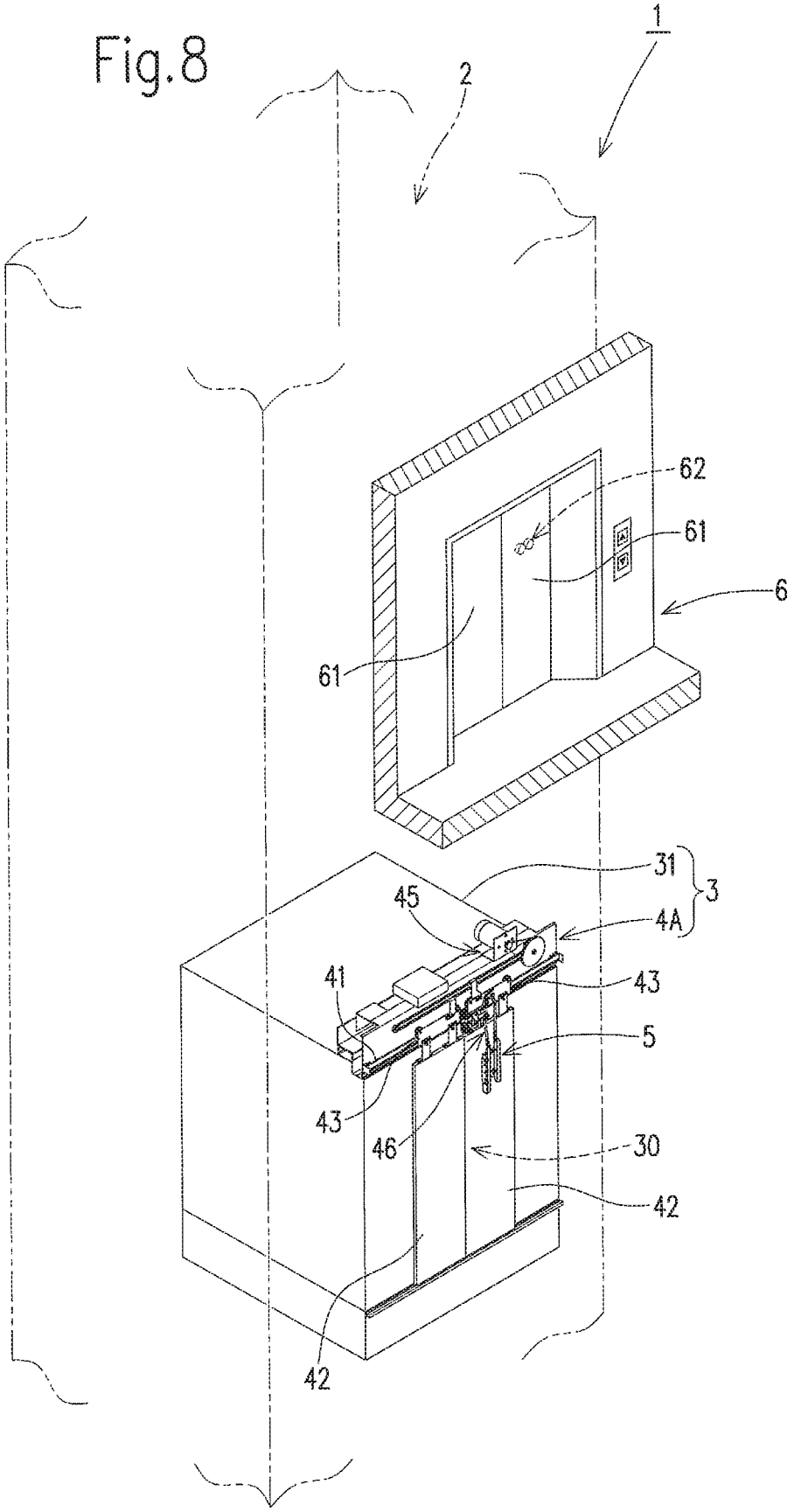
FIG. 8 is a schematic diagram showing a configuration of an elevator according to a second embodiment.

As shown in FIG. 8, the elevator of this embodiment includes an elevator shaft 2 and a car 3 that is raised or lowered within the elevator shaft. In the same manner as the elevator of the first embodiment, the elevator 1 of this embodiment is configured to open and close the landing doors 61 following the car doors 42 when the car doors 42 open and close when the car 3 lands a desired floor.

Figure 9:
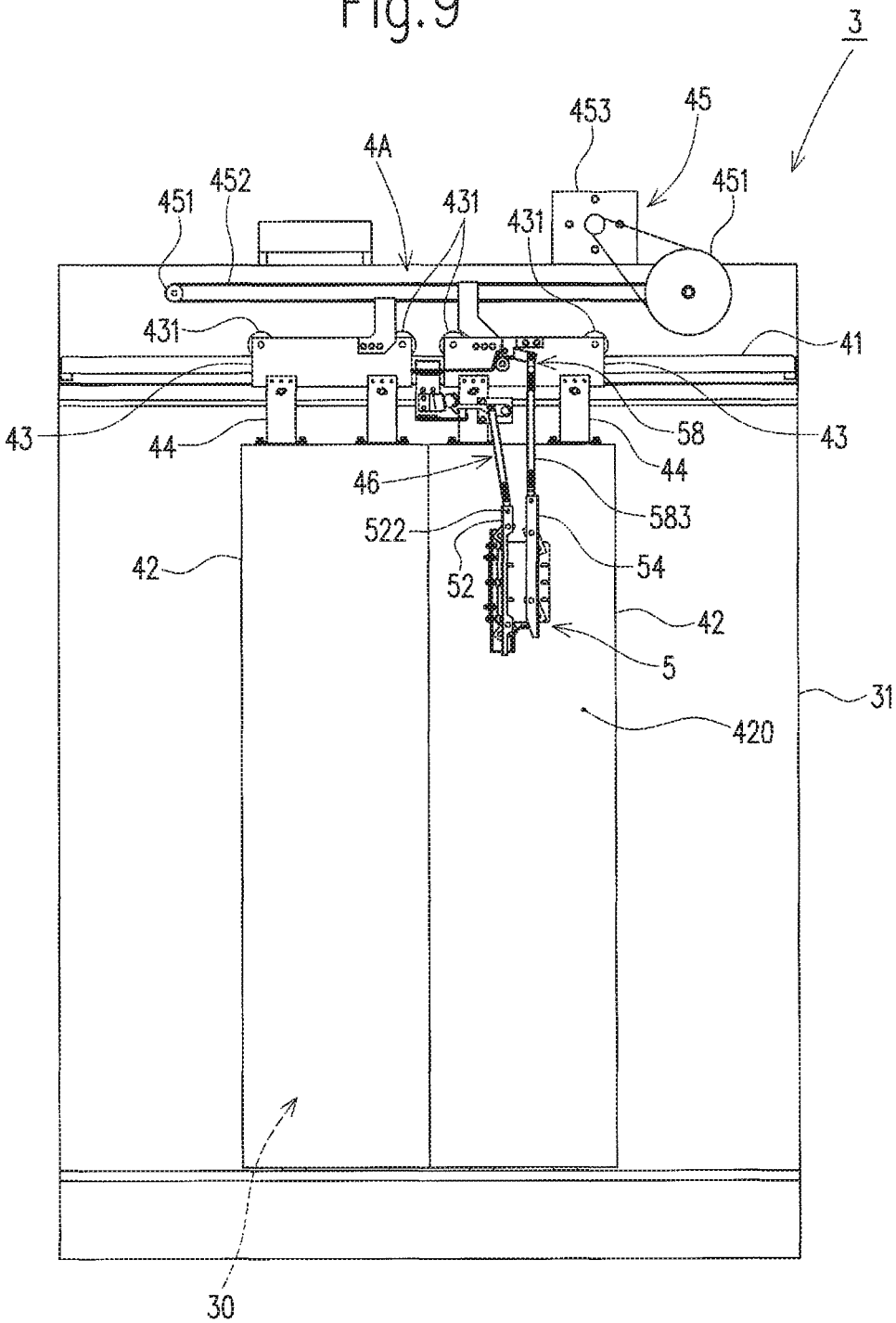
FIG. 9 is a front view of a car of the elevator.

As shown in FIG. 9, the car 3 includes a car body 31 having an entrance 30, and a door device 4A arranged on the car body 31.

The door device 4A of this embodiment has an identical configuration to the door device 4 of the first embodiment except that a locking mechanism 46 capable of locking the car doors 42 is provided. That is, the door device 4A of this embodiment includes a guide rail 41 that guides the car doors 42, the car doors 42 that open and close the entrance 30 of the car body 31, a door hangers 43 that respectively allow the car doors 42 to reciprocate along the guide rail 41 while respectively allowing the car doors 42 to directly or indirectly hang down therefrom, an engagement device 5 that transmits driving force to open and close the car door 42 to the landing doors 61, and a locking mechanism 46 that locks or unlocks the car doors 42. The door hangers 43 of this embodiment allows the car doors 42 to hang down therefrom via intermediate members 44.

In the engagement device 5 of this embodiment, each of the first member contact parts 561*a* are adjusted to be located at a position with a distance from the first member 52 at the first position in the restricting part 56. That is, the first member 52 is in the condition capable of pivotally moving from the first position to the second position side.

Figure 11:
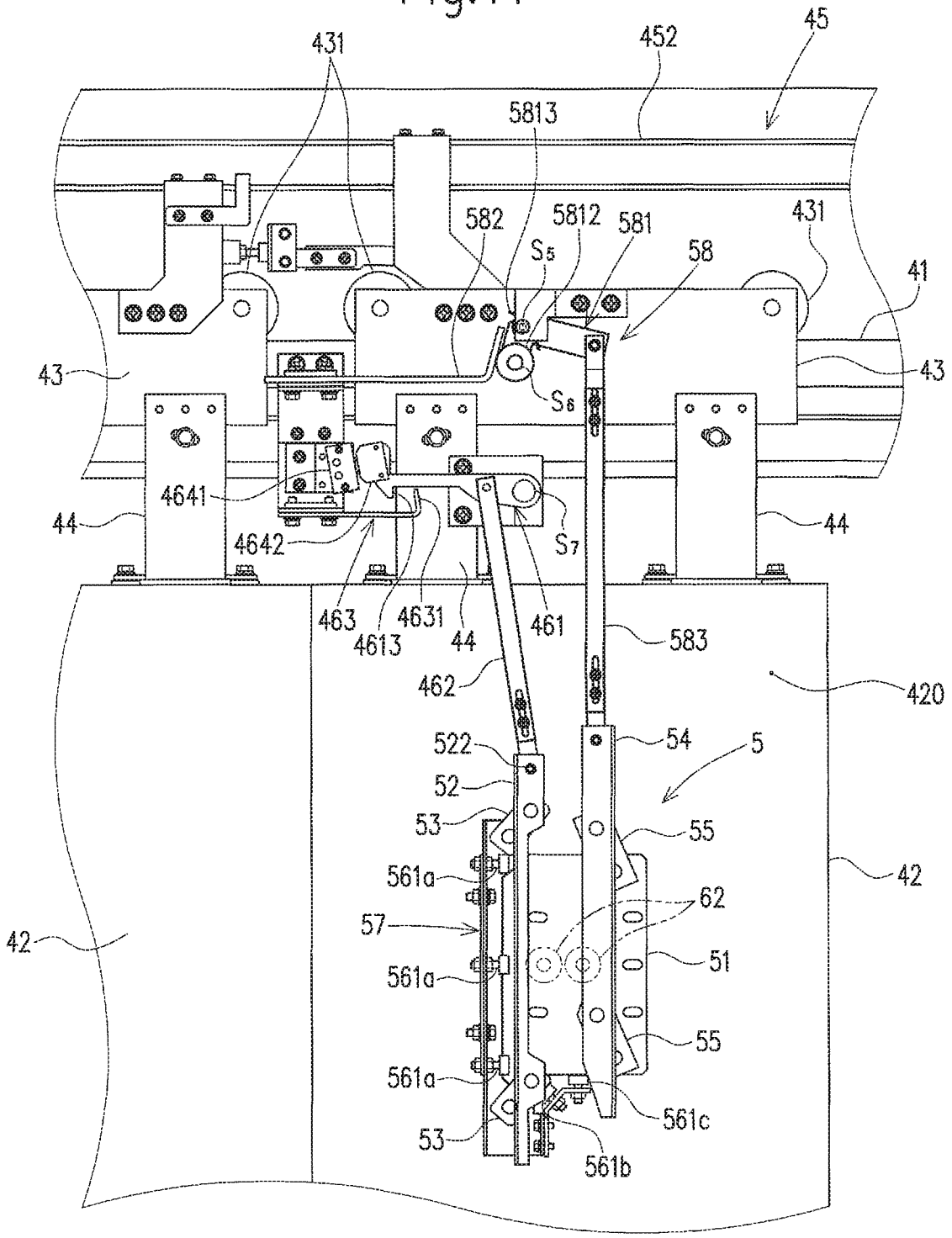
FIG. 11 is an explanatory diagram for the motion of the engagement device and the locking mechanism.
Figure 12:
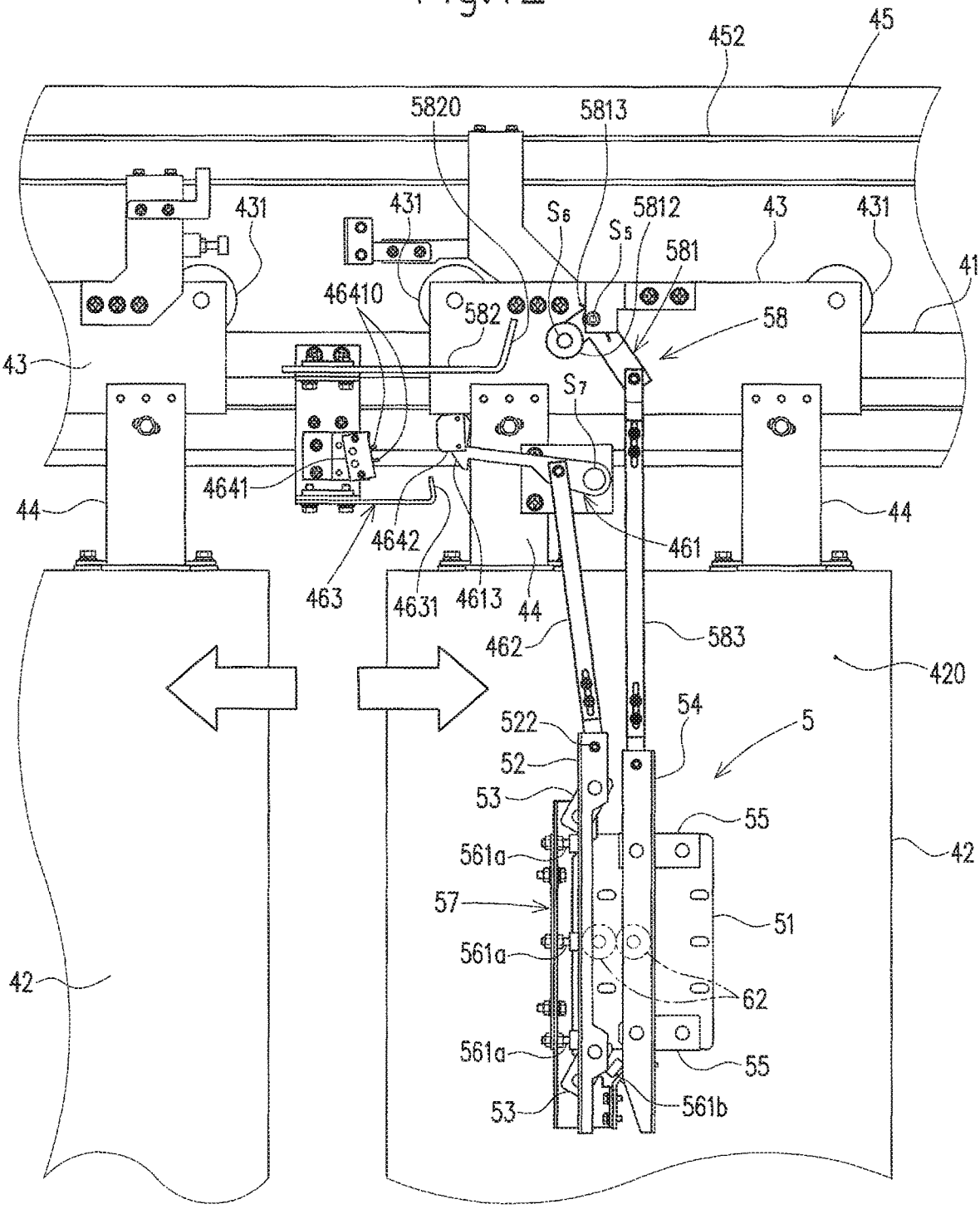
FIG. 12 is an explanatory diagram for the motion of the engagement device and the locking mechanism.
Figure 13:
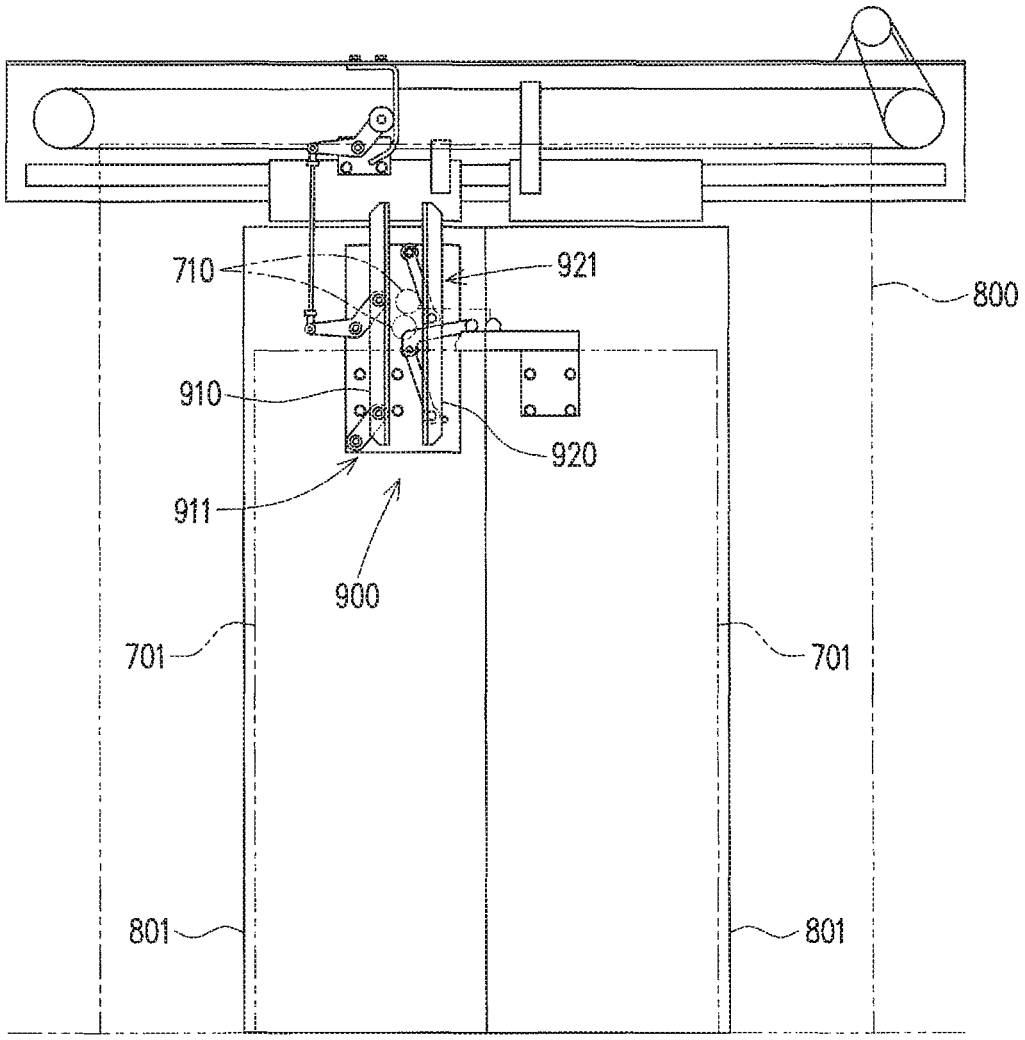
FIG. 13 is a schematic diagram for explaining a conventional engagement device.

The locking mechanism 46 is configured to lock so as not to open the car doors 42 when the car doors 42 are at the fully-closed position, and unlock when the car doors 42 move from the fully-closed position toward the door opening direction. Specifically, as shown in FIG. 10 to FIG. 12, the locking mechanism 46 includes an engaging part 461 that is mounted on the door hanger 43 or the intermediate member 44 arranged between the door hanger 43 and the car door 42, a transmission member 462 that transmits driving force from the engagement device 5 (i.e., the pivotal movement of the first member 52) to the engaging part 461, and a locking mechanism engaged part 463 that is mounted on the car body 31 or a member or part fixed to the car body 31. In the locking mechanism 46, the engaging part 463 engages with the locking mechanism engaged part 463 (comes into an engaging position), thereby locking the car doors 42 from opening (specifically, locking the two car doors 42 from moving in a direction away from each other). The locking mechanism 46 of this embodiment further includes a detector 464 that can detect whether the locking mechanism 46 is in locking or unlocking state.

The engaging part 461 includes a base 4611 that is pivotally movable around a shaft $S_7$ extending in the entrance direction, an extending part 4612 that extends from the base 4611 and to which the transmission member 462 is relatively rotatably connected, and a hook 4613 that is arranged at a distal end (i.e., an end opposite to the base 4611) of the extending part 4612. When the engaging part 461 is pushed upward through the transmission member 462 by the pivotal movement of the first member 52 (from the state shown in FIG. 11 to the state shown in FIG. 12) the engaging part 461 pivotally moves around the shaft $S_7$ to come into a position where it is out of engagement with the engaged body 71 (the releasing position) (see FIG. 12). On the other hand, when the engaging part 461 is pulled downward through the transmission part 462 by the pivotal movement of the first member 52 (from the state shown in FIG. 12 to the state shown in FIG. 11), the engaging part 461 pivotally moves around the shaft $S_7$ (the pivotal movement in the opposite direction to the direction of the pivotal movement when coming into the releasing position) to come into a position where it can engage with the locking mechanism engaged part 463 (the engaging position) (see FIG. 11).

The locking mechanism engaged part 463 is a plate-shaped member fixed to the guide rail 41 and extending in the door opening direction, and has a bent portion at a distal end 4631. The distal end 4631 can be engaged with the engaging part 461 (i.e., the hook 4613) when in an engaging position.

The detector 464 includes a switch 4641 that is fixed to the locking mechanism engaged part 463, and a contact 4642 that is arranged at the hook 4613 of the engaging part 461. The switch 4641 has two contact points 46410 and is configured to detect that the car doors 42 are held locked through the conduction of the two contact points 46410. The contact 4642 is arranged at such a position as to contact the two contact points 46410 of the switch 4641 (to enable the conduction between the two contact points 46410) when the engaging part 461 is in the engaging position.

The transmission member 462 transmits the driving force of the driving device 45 to the engaging part 461 by the connection of the first member 52 with the engaging part 461. Specifically, the transmission member 462 is an elongated member extending in a certain direction and has an upper end relatively rotatably connected to the extending part 4612 of the engaging part 461, and a lower end relatively rotatably connected to the connection part 522 of the first member 52. The transmission member 462 transmits the pivotal movement of the first member 52 (vertical movement) to the engaging part 461. The transmission member 462 of this embodiment is adjustable in length.

In the elevator 1 configured as described above, the engagement device 5 transmits driving force to open and close the car doors 42 to the landing doors 61 when the car doors 42 open and close, to thereby enable the landing doors 61 to open and close follow the car doors 42, in the same manner as the elevator of the first embodiment.

Further, the locking mechanism 46 of the elevator 1 of this embodiment locks the car doors 42 by the closing of the car doors 42, and unlocks the car doors 42 by the opening of the car doors 42. A specific description on this will be given below.

In the state where the car 3 lands a desired floor and then the engaged part 62 of the landing door 61 is located between the first member 52 and the second member 54 (see FIG. 11), the first member 52 (i.e., the first holding surface 521) comes into contact with the engaged part 62 of the landing door 61 when the driving device 45 drives the door hangers 43 to respectively move the car doors 42 from the fully-closed position in the door opening direction. When the car doors 42 further move from this state in the door opening direction, the first member 52 is pushed by the engaged part 62 and thereby pivotally move toward the second position. Thereby, the engaging part 461 (the extending part 4612) is pushed upward through the transmission member 462 by the pivotal movement of the first member 52. Thereby, the engaged part 461 pivotally moves around the shaft $S_7$ and the hook 4613 is pushed upward to come into the releasing position to be released from the engagement with the locking mechanism engaged part 463 (see FIG. 12). Thus, the car doors 42 are unlocked and hence respectively movable to the fully-opened position.

On the other hand, when the doors are closed, the cam 581 comes into contact with the cam contact part 582 just before the car doors 42 reach the fully-closed position to thereby allow the second member 54 to be pulled upward (through pivotal movement) by the coupling member 583, so that the engaged part 62 is released from the held (sandwiched) state by the first member 52 and the second member 54. This pivotal movement of the first member 52 from the second position to the first position side by its own weight or the like allows the engaging part 461 (i.e., the extending part 4612) to be pulled downward through the transmission member 462. Thereby, the engaging part 461 pivotally moves around the shaft $S_7$ to pull the hook downward and thereby allows the same to come into the engaging position to engage with the locking mechanism engaged part 463. That is, the locking mechanism 46 is held in a locking state to lock the car doors 42 (see FIG. 11).

When the locking mechanism 46 is held in the locking state, that is, the engaging part 461 comes into the engaging position, the contact 4642 arranged at the engaging part 461 enables the conduction between the two contact points 46410 of the switch 4641, and thereby enables the detector 464 to detect that the car doors 42 have been locked by the locking mechanism 46. Upon the detection, the car 3 can be raised or lowered.

Also in the aforementioned elevator 1, the range of the pivotal movement of the first member 52 can be restricted by the restricting part 56 of the engagement device 5. That is, the range of pivotal movement of the first member 52 can be adjusted by adjusting the positions of the first member contact part 561*a* and the first link member contact part 561*b*. Thus, the distance between the first member 52 and the second member 54 can be adjusted to fit to the engaged part 62 of the landing door (i.e., the opposite door) 61.

Further, according to the thus configured restricting part 56, the first member contact part 561*a* and the first link member contact part 561*b* allow the screws 5612 to be screwed in the screw holes 5710, 5720 of the holding part 57. Thus, the distance between the first member 52 and the second member 54 can be further changed (adjusted), for example, in the case where the engaged part 62 has been replaced with a new one, even after the distance between the first member 52 and the second member 54 at the time of opening and closing the car door 42 has been adjusted to fit to the engaged part 62 of the landing door (i.e., the opposite door) 61.

The elevator door engagement device according to the present invention is not limited to the aforementioned embodiments, and it is a matter of course that various modifications can be made without departing from the gist of the present invention. For example, the configuration of a particular embodiment can be added to the configuration of another embodiment, and a part of the configuration of a particular embodiment can be replaced with the configuration of another embodiment. In addition, a part of the configuration of a particular embodiment can be eliminated.

The engagement device 5 of the aforementioned embodiment is mounted to the car door 42, but not limited thereto. The engagement device 5 may be mounted to the landing door 61. In this case, the door device 4 including the driving device 45 and the like is arranged on the landing floor 6.

In the engagement device 5 of the aforementioned embodiments, the connection part 522 is configured to have a shaft bush with a hole thorough which a bolt is insertable or a shaft bush for receiving the bolt, but not limited to thereto. That is, the connection part 522 of the first member 52 is not limited to a specific configuration.

The locking mechanism 46 of the door device 4 is not limited to a specific configuration, provided that it can lock and unlock the car doors 42 or the landing doors 61 using the pivotal movement of the first member 52.

The restricting part 56 is not limited to a specific configuration, provided that it can releasably restrict the pivotal movement of the first member 52 to a certain range.

The restricting part 56 of the aforementioned embodiment can restrict the pivotal movement of the first member 52 to a desired range between the first position and the second position, but not limited thereto. For example, the restricting part 56 may be configured to selectively restrict (fix) the first member 52 at any position among a plurality of positions set between the first position and the second position.

The restricting part 56 of the engagement device 5 of the aforementioned embodiment restricts the pivotal movement of the first member 52 to a certain range, but not limited thereto. For example, it may be configured such that the other part or member (i.e., the part or member other than the restricting part 56) of the engagement device 5 restricts the pivotal movement of the first member 52 to a certain range, and the restricting part 56 releasably fixes the first member 52 at a desired position (that is, restricts the pivotal movement), for example, releasably fixes the first member 52 at the first position.

The door device 4 (i.e., the elevator 1) of the aforementioned embodiment is a so-called center open type door device in which two (a plurality of) car doors 42 open toward both sides in the width direction of the entrance 30, but not limited thereto. The door device 4 (i.e., the elevator 1) may be a so-called single door type door device in which the car door 42 opens toward one side in the width direction of the entrance 30.

The first member contact part 561*a*, the first link member contact part 561*b*, and the second link member contact part 561 are not limited to a specific configuration, provided that they can respectively restrict the movements itself (or restrict the movements to certain ranges) of the first member 52, the first link member 53, and the second link member 55.

The door engagement device as one embodiment will be summarized as below. That is, the door engagement device is configured to engage with an engaged part, which is mounted to a landing door or a car door of an elevator, and thereby be able to transmit driving force to open and close the car door or the landing door, the door engagement device including: a first member that extends in a vertical direction and is able to come into contact with an engaged part from a door closing direction side; a second member that extends in the vertical direction at a position with a distance from the first member to a door opening side and is able to come into contact with the engaged part from a door opening direction side; a link member that forms a parallel link mechanism in cooperation with the first member so as to enable the first member to pivotally move between a predetermined first position and a predetermined second position located closer to the door closing direction side than the first position while keeping the posture of the first member; and a restricting part that releasably restricts the pivotal movement of the first member at the first position.

According to this configuration, the pivotal movement of the first member can be restricted by the restricting part at the first position. Thus, the distance between the first member and the second member at the time of opening and closing the car door or the landing door can be adjusted to fit to the engaged part of the opposite door for the case where the first member is restricted by the restricting part at the first position (i.e., the distance between the first member and the second member when the first member is located at the first position) and for the case where the first member is not restricted by the restricting part at the first position (for example, the distance between the first member and the second member when the first member is located at the second position).

Also, since the restricting part releasably restricts the pivotal movement of the first member, the distance between the first member and the second member can be changed, even after the distance between the first member and the second member at the time of opening and closing the car door or the landing door is adjusted to fit to the engaged part of the opposite door.

In the door engagement device, the restricting part is preferably capable of restricting the pivotal movement of the first member at a desired position between the first position and the second position.

According to this configuration, the distance between the first member and the second member at the time of opening and closing the car door or the landing door can be more appropriately adjusted.

In this case, the door engagement device may be configured such that, for example, the restricting part includes: at least one first member contact part that restricts the first member from further pivotally moving toward the second position side, when the at least one first member contact part has come into contact with the first member from the door closing side; and a holding part that holds the first member contact part, while being fixed to the car door or the landing door, the holding part having a screw hole extending in the door closing direction, the number of which corresponds to the number of the first member contact part, the at least one first member contact part having a screw part to be screwed in the screw hole from the door opening side.

According to this configuration, the screw part is rotated to adjust the first member contact part to be located at a desired position in the opening and closing direction. Thereby, it is configured to allow the first member contact part to come into contact with the first member from the door closing side at a desired position (i.e., at the position adjusted by rotating the screw part) between the first position and the second position, when the first member has pivotally moved from the first position toward the second position side so that the first member can be restricted from further pivotally moving toward the second position side.

The door engagement device may be configured such that the restricting part includes at least one link member contact part that restricts the first member from further pivotally moving toward the first position when the at least one link member contact part has come into contact with the link member, and the holding part holds the at least one link member contact part in such a manner as to be able to adjust the position of the at least one link member contact part.

According to this configuration, the position of the first link member contact part is adjusted to come into contact with the first link member at a desired position between the second position and the first position when the first member has pivotally moved from the second position toward the first position side, so that the first member can be restricted from further pivotally moving toward the first position side.

Further, the number of parts or members can be reduced by configuring the holding part to be also capable of holding the link member contact part, compared with the configuration where parts or members for holding the first member contact part and parts or members for holding the link member contact part are separately provided.

In this case, it may be configured such that the at least one link member contact part has the same configuration as the at least one first member contact part, and the holding part has a screw hole, into which the screw part of the at least one link member contact part is screwed, the number of the screw hole corresponding to the at least one link member contact part.

With the first link member contact part and the first member contact part having the same configuration, the kinds of members or parts can be reduced and the holding part can have a simplified configuration. That is, the same configuration can be employed for holding the first member contact part first member contact part as that for holding the first link member contact part.

In the door engagement device, the first member may include a connection part for connecting a transmission member of a locking member that locks and unlocks the car door or the landing door by motion transmitted by the transmission member.

According to this configuration, when the door engagement device is used in an elevator having a locking mechanism, the locking mechanism can be actuated utilizing the motion (pivotal movement) of the first member at the time of opening and closing the car door or the landing door as the driving force by connecting the transmission member with the first member.

The door engagement device may be configured to further include: a link member that forms a parallel link mechanism in cooperation with the second member so as to enable the second member to pivotally move between a third position, at which the second member is located close to the first member, and a forth position closer to a door opening direction side than the third position while keeping the posture of the second member; and a restricting part that restricts the second member from pivotally moving at the third position, wherein the link member is subjected to a downward force when the engaged part has come into contact with the second member.

According to this configuration, it is possible to prevent an event in which, when the car door in the closed state starts its closing operation and the second member receives the force from the engaged part, the second member jumps up and thereby the landing door fails to follow the car door and hence causes deviation (delay) of the relative timing of the door closing.

REFERENCE SIGNS LIST

1: Elevator
2: Elevator shaft
3: Car
30: Entrance
31: Car body
4, 4A: Door device
41: Guide rail
42: Door
420: Opposite surface
43: Door hanger
431: Roller
44: Intermediate member
45: Driving device
451: Pulley
452: Belt body
453: Roller
46: Locking mechanism
461: Engaging part
4611: Base
4612: Extending part
4613: Hook
462: Transmission member
463: Locking mechanism engaged part

4631: Distal end
464: Detector
4641: Switch
46410: Contact point
4642: Contact
5: Engagement device
51: Base
52: First member
521: First holding surface
522: Connection part
53: First link member
54: Second member
541: Second holding surface
55: Second link member
56: Restricting part
561*a*: First member contact part
561*b*: First link member contact part (Link member contact part)
561*c*: Second link member contact part
5611: Contact part body
5612: Screw part
57: Holding part
571: First portion
572: Second portion
573: Third portion
5710, 5720, 5730: Screw hole
58: Second member driving mechanism
581: Cam
5811: Cam body
5811*a*: First portion
5811*b*: Second portion
5812: Contact roller
5813: Biasing member
582: Cam contact part
5820: Contact surface
583: Coupling member
6: Landing floor
61: Landing door
62: Engaged part (Catch roller)
701: Landing door
710: Engaged part
710: Interlock roller
801: Door
900: Engagement device
910: Door pocket side blade
911, 921: Parallel link mechanism
920: Door stopper side blade
$S_1$, $S_2$, $S_3$, $S_4$, $S_5$, $S_6$, $S_7$: Shaft

What is claimed is:

1. A door engagement device configured to engage with an engaged part, which is mounted to a landing door or a car door of an elevator, and thereby be able to transmit driving force to open and close the car door or the landing door, the door engagement device comprising:

a first member that extends in a vertical direction and is able to come into contact with the engaged part from a door closing direction side;

a second member that extends in the vertical direction at a position with a distance from the first member to a door opening side and is able to come into contact with the engaged part from a door opening direction side;

a first link member that forms a parallel link mechanism in cooperation with the first member so as to enable the first member to pivotally move between a predetermined first position and a predetermined second position located closer to the door closing direction side than the first position while keeping a posture of the first member; and a first restricting part that releasably restricts the pivotal movement of the first member at the first position;

a second link member that forms a parallel link mechanism in cooperation with the second member so as to enable the second member to pivotally move between a third position, at which the second member is located close to the first member, and a forth position closer to a door opening direction side than the third position while keeping a posture of the second member; and a second restricting part that restricts the second member from pivotally moving at the third position, wherein the second link member is connected to the base to be relatively rotatable around a shaft $S_3$ extending in the entrance direction, while being connected to the second member to be relatively rotatable around a shaft $S_4$ extending in the entrance direction, the second restricting part includes a second link member contact part that comes into contact with the second link member, thereby restricting the second link member from further pivotally moving, and the second link member, when it has come into contact with the second link member contact part, takes a position allowing a virtual line Z connecting the shaft $S_3$ and the shaft $S_4$ to be downwardly inclined toward the engaged part side so that the second link member is subjected to a downward force when the engaged part has come into contact with the second member.

2. The door engagement device according to claim 1, wherein the first restricting part is capable of restricting the pivotal movement of the first member at a desired position between the first position and the second position.

3. The door engagement device according to claim 2, wherein the first restricting part comprises:

at least one first member contact part that restricts the first member from further pivotally moving toward the second position side, when the at least one first member contact part has come into contact with the first member from the door closing side; and a holding part that holds the first member contact part, while being fixed to the car door or the landing door, the holding part having a screw hole extending in the door closing direction, the number of which corresponds to the number of the first member contact part, the at least one first member contact part having a screw part to be screwed in the screw hole from the door opening side.

4. The door engagement device according to claim 2, wherein the first member comprises a connection part for connecting a transmission member of a locking member that locks and unlocks the car door or the landing door by motion transmitted by the transmission member.

5. The door engagement device according to claim 3, wherein the first restricting part comprises at least one first link member contact part that restricts the first member from further pivotally moving toward the first position when the at least one first link member contact part has come into contact with the link member, and the holding part holds the at least one first link member contact part in such a manner as to be able to adjust the position of the at least one first link member contact part.

6. The door engagement device according to claim 3, wherein the first member comprises a connection part for connecting a transmission member of a locking member that locks and unlocks the car door or the landing door by motion transmitted by the transmission member.

7. The door engagement device according to claim 5, wherein the at least one first link member contact part has the same configuration as the at least one first member contact part, and the holding part has a screw hole, into which the screw part of the at least one first link member contact part is screwed, the number of the screw hole corresponding to the at least one first link member contact part.

8. The door engagement device according to claim 5, wherein the first member comprises a connection part for connecting a transmission member of a locking member that locks and unlocks the car door or the landing door by motion transmitted by the transmission member.

9. The door engagement device according to claim 7, wherein the first member comprises a connection part for connecting a transmission member of a locking member that locks and unlocks the car door or the landing door by motion transmitted by the transmission member.

10. The door engagement device according to claim 1, wherein the first member comprises a connection part for connecting a transmission member of a locking member that locks and unlocks the car door or the landing door by motion transmitted by the transmission member.

* * * * *